US009366433B2

(12) United States Patent
Arensmeier

(10) Patent No.: US 9,366,433 B2
(45) Date of Patent: Jun. 14, 2016

(54) CONTROL FOR MONITORING FLAME INTEGRITY IN A HEATING APPLIANCE

(75) Inventor: Jeffrey N. Arensmeier, Fenton, MO (US)

(73) Assignee: Emerson Electric Co., St. Louis, MO (US)

( * ) Notice: Subject to any disclaimer, the term of this patent is extended or adjusted under 35 U.S.C. 154(b) by 730 days.

(21) Appl. No.: 12/873,560

(22) Filed: Sep. 16, 2010

(65) Prior Publication Data

US 2011/0070550 A1 Mar. 24, 2011

(51) Int. Cl.

| | |
|---|---|
| ***F23N 1/02*** | (2006.01) |
| ***F23N 5/12*** | (2006.01) |
| ***G05B 21/00*** | (2006.01) |
| ***G06F 11/30*** | (2006.01) |
| ***G08B 23/00*** | (2006.01) |
| ***F23N 5/18*** | (2006.01) |
| ***F23N 3/08*** | (2006.01) |

(52) U.S. Cl.

CPC ..... *F23N 1/022* (2013.01); *F23N 3/082* (2013.01); *F23N 5/123* (2013.01); *F23N 5/18* (2013.01); *F23N 5/12* (2013.01); *F23N 2029/08* (2013.01); *F23N 2029/12* (2013.01); *F23N 2033/08* (2013.01)

(58) Field of Classification Search

CPC ..... F23N 1/022; F23N 5/123; F23N 5/18; F23N 2029/12

USPC ..... 431/18, 24; 700/274; 702/182; 340/500

See application file for complete search history.

(56) References Cited

U.S. PATENT DOCUMENTS

| | | | |
|---|---|---|---|
| 336,749 | A | 2/1886 | Rotthoff |
| 3,304,989 | A | 2/1967 | Alexander et al. |
| 3,627,458 | A | 12/1971 | Wade |
| 3,740,574 | A | 6/1973 | Taylor |
| 3,820,097 | A | 6/1974 | Larson |
| 3,940,753 | A | 2/1976 | Müller |

(Continued)

FOREIGN PATENT DOCUMENTS

| | | | |
|---|---|---|---|
| DE | 19831648 A1 * | 1/2000 | ..... F23N 5/12 |
| DE | 10220772 | 11/2003 | |
| DE | 10220773 | 11/2003 | |

OTHER PUBLICATIONS

European Extended Search Report dated Nov. 20, 2012 from counterpart European Patent Application No. 11177579.7 which claims priority to the instant application; 4 pgs.

*Primary Examiner* — William G Corboy

(74) *Attorney, Agent, or Firm* — Harness, Dickey & Pierce, P.L.C.

(57) ABSTRACT

A control apparatus for a gas-fired heating appliance having a burner is provided for sensing burner flame instability. The apparatus includes a sensor for sensing a flame and providing an output of a flame current signal, and a controller in communication with the sensor for sensing flame current. The controller is configured to receive the flame current signal and to detect the occurrence of a flame instability condition. The controller detects flame instability from flame current signal data that is measured and Fourier transformed into a frequency spectrum which changes from a stable to instable spectrum when flame instability is caused by an inadequate air-to-fuel ratio. The controller is configured to respond to flame instability by generating an output signal to increase the speed of a combustion air blower that supplies air to the burner, to thereby increase the air flow relative to fuel flow until normal combustion is attained.

1 Claim, 6 Drawing Sheets

(56) References Cited

U.S. PATENT DOCUMENTS

| | | | | | |
|---|---|---|---|---|---|
| 4,032,285 | A | | 6/1977 | Rohr et al. | |
| 4,039,844 | A | | 8/1977 | MacDonald | |
| 4,043,742 | A | | 8/1977 | Egan et al. | |
| 4,059,385 | A | | 11/1977 | Gulitz et al. | |
| 4,088,984 | A | | 5/1978 | Muramoto et al. | |
| 4,157,506 | A | | 6/1979 | Spencer | |
| 4,249,168 | A | | 2/1981 | Muggli | |
| 4,296,727 | A | | 10/1981 | Bryan | |
| 4,348,169 | A | | 9/1982 | Swithenbank et al. | |
| 4,461,615 | A | | 7/1984 | Inoue | |
| 4,540,886 | A | * | 9/1985 | Bryant | 250/554 |
| 4,653,998 | A | * | 3/1987 | Sohma et al. | 431/79 |
| 4,913,647 | A | | 4/1990 | Bonne et al. | |
| 4,927,350 | A | | 5/1990 | Zabielski | |
| 4,934,926 | A | | 6/1990 | Yamazaki et al. | |
| 5,037,391 | A | | 8/1991 | Hammerslag et al. | |
| 5,049,063 | A | | 9/1991 | Kishida et al. | |
| 5,077,550 | A | | 12/1991 | Cormier | 340/578 |
| 5,112,217 | A | | 5/1992 | Ripka et al. | |
| 5,120,214 | A | | 6/1992 | West et al. | |
| 5,145,355 | A | | 9/1992 | Poinsot et al. | |
| 5,190,454 | A | | 3/1993 | Murray et al. | |
| 5,222,887 | A | | 6/1993 | Zabielski, Sr. | |
| 5,480,298 | A | | 1/1996 | Brown | |
| 5,785,512 | A | | 7/1998 | Cormier | |
| 5,971,745 | A | * | 10/1999 | Bassett et al. | 431/12 |
| 5,997,280 | A | * | 12/1999 | Welz et al. | 431/90 |
| 6,261,086 | B1 | | 7/2001 | Fu | |
| 6,318,891 | B1 | | 11/2001 | Haffner et al. | |
| 6,350,988 | B1 | | 2/2002 | Brown | |
| 6,356,199 | B1 | | 3/2002 | Niziolek et al. | 340/579 |
| 6,404,342 | B1 | | 6/2002 | Planer et al. | |
| 6,676,404 | B2 | | 1/2004 | Lochschmied | 431/75 |
| 6,783,355 | B2 | | 8/2004 | Blaauwwiekel | 431/25 |
| 7,112,796 | B2 | | 9/2006 | Brown et al. | 250/339 |
| 7,241,135 | B2 | | 7/2007 | Munsterhuis et al. | 431/12 |
| 7,255,285 | B2 | | 8/2007 | Troost et al. | |
| 7,353,140 | B2 | * | 4/2008 | Daw et al. | 702/182 |
| 7,966,080 | B2 | * | 6/2011 | Jia et al. | 700/29 |
| 2004/0011051 | A1 | * | 1/2004 | Ryan et al. | 60/773 |
| 2010/0298983 | A1 | * | 11/2010 | Beste et al. | 700/276 |

* cited by examiner

CONTROL FOR MONITORING FLAME INTEGRITY IN A HEATING APPLIANCE

FIELD

The present disclosure relates to control of burner operation, and more particularly to detecting characteristics of ionization current resulting from a burner flame.

BACKGROUND

This section provides background information related to the present disclosure which is not necessarily prior art. Gas fired heating appliances use a source of gas and a source of air that are mixed and transmitted to a burner where an igniter initiates combustion. However, the ratio of gas to air in the gas/air mixture is essential to maintaining good combustion and keeping efficiency within an acceptable range. While a flame becomes more conductive as the ratio of the air/fuel mixture approaches near-stoichiometric conditions, attempts to use ionic flame monitoring to maintain a peak flame rod current have resulted in incomplete combustion due to shortage of primary air, as disclosed in U.S. Pat. No. 6,356,199 to Niziolek. Moreover, the sensor supplying the ionization signal ages during burner operation as a result of dirt deposited on the sensor and chemical decomposition, which makes the ionization sensor signal no longer reliable since the electrical behavior of the sensor changes, as disclosed in U.S. Pat. No. 6,783,355 to Blaauwwiekel. Thus, ionic flame monitoring equipment is only reliable for indicating a flame presence, and does not provide reliable feedback over time about the quality of the flame.

SUMMARY

This section provides a general summary of the disclosure, and is not a comprehensive explanation of the full scope of the disclosure or all of its features.

Various embodiments of a system and apparatus are provided for controlling operation of a gas-fired heating appliance having a burner. In one embodiment, a control apparatus is provided for sensing burner flame instability. The apparatus includes a sensor for sensing a flame and providing an output of a flame current signal, and a controller in communication with the sensor for sensing flame current. The controller is configured to receive the flame current signal and to detect the occurrence of a flame instability condition. The controller detects flame instability from flame current signal data that is measured and Fourier transformed into a frequency spectrum which changes from a stable to instable spectrum when flame instability is caused by an inadequate air-to-fuel ratio. The controller is configured to respond to the flame instability condition by generating an output signal to increase the speed of a combustion air blower that supplies air to the burner, to thereby increase the air flow rate relative to the fuel flow rate until the controller determines that the flame current signal is indicative of normal combustion.

According to another aspect of the present disclosure, a method for controlling the operation of a gas-fired heating appliance is provided. The method comprises sensing a flame and providing an output of a flame current signal. The method further comprises monitoring the flame current signal to detect an occurrence of flame instability by measuring the sensed flame current signal waveform at a given data sampling rate, and transforming the measured data into a spectrum of frequency components of varying amplitude for detecting a change from a generally steady spectrum indicative of flame stability to an instable spectrum indicative of flame instability. The method further includes reducing the speed of the combustion air blower to reduce the flow of combustion air to the burner until the occurrence of flame instability is detected by the monitoring process, and thereafter increasing the speed of the combustion air blower until the flame current signal and its measured spectrum are indicative of flame stability and normal combustion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

In the various embodiments of a control for a heating appliance, a control apparatus is provided for sensing flame instability that may be caused by an inadequate air-to-fuel ratio, for example. The apparatus includes a sensor for sensing a flame and generating a flame current signal, and a controller in communication with the sensor. The controller is configured to receive the flame current signal and to detect the occurrence of a flame instability condition from flame current signal data that is measured and Fourier transformed into a frequency spectrum which changes from a stable to an instable spectrum when flame instability occurs. The controller is configured to respond to the detection of a flame instability condition by generating an output signal to adjust the speed of a combustion air blower supplying air to the burner, to thereby adjust the air flow relative to fuel flow until the controller detects a flame current signal that is indicative of normal combustion. It should be noted that the sensor for sensing flame at the burner may be any number of sensor configurations that generate an appropriate flame current signal, as explained below.

Figure 1:
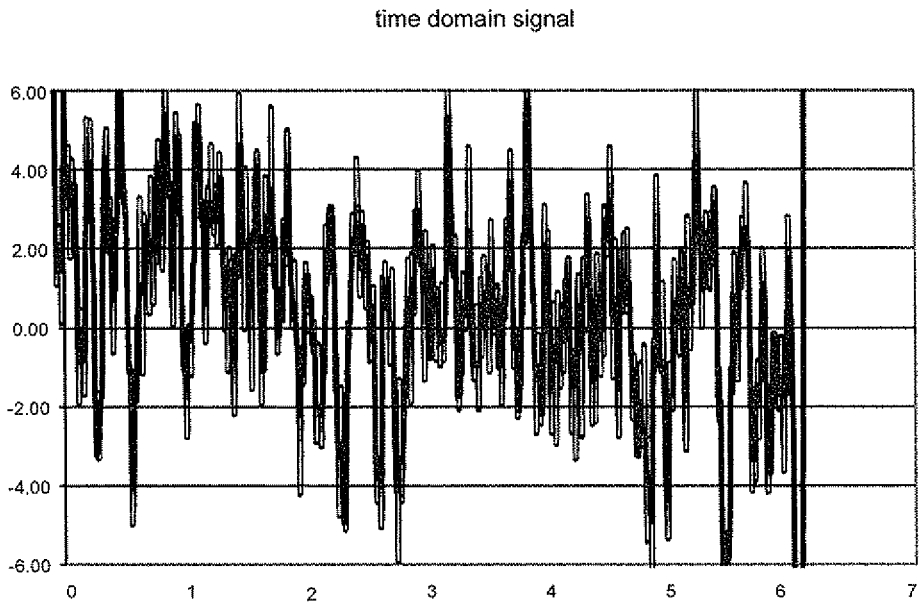
FIG. 1 shows a flame current signal during normal combustion, as utilized in various system and apparatus embodiments of the present disclosure.

To generate a flame current signal, an alternating current line voltage source may be applied across a flame zone that lies between a flame probe electrode and an electrical contact at the burner that is spaced from the probe electrode. Since a flame is characterized by a stream of ions that induce flame ionization, the flame imparts a direct current voltage to the alternating current that is applied across the flame probe electrode and the electrical contact (e.g., electrical ground). This phenomenon is referred to as flame rectification. The resulting flame current waveform generally varies depending on flame consistency. Thus, in the presence of a flame, a time varying flame current signal is generated that is characterized by various frequency components, such as that of the 60 Hertz frequency of the line voltage applied across the flame. However, when a flame current signal in normal combustion is viewed on an oscilloscope (as shown in FIG. 1), the displayed waveform only provides a measure of noise amplitude of the overall flame current signal. Moreover, it is difficult to characterize or quantify the distortion caused by the ionizing current to the alternating current sine waveform, and no characterization as to flame quality can be derived from the flame current signal due to its noise. While analog filters can be used to isolate select frequencies within the flame current signal by tuning the filters and repeating measurements to identify select frequencies within the flame current signal, this process would be tedious and time consuming.

In the apparatus of the first embodiment, the flame current input signal is measured, or digitized, at a high sampling rate and then transformed by a Fast Fourier Transform algorithm. The flame current signal is first passed through an analog filter to attenuate all frequency components above the frequency range in which the signal is to be analyzed. Nyquist's theorem indicates that a sampling rate should be at least twice the maximum frequency component of the filtered signal for the sampled data to accurately represent the input signal, where the frequency resolution is $\Delta v - 1/T$ (the inverse of the time T over which the waveform is measured and Fourier transformed). In the present application, the primary frequency range of interest is from near DC (direct current) to at least 1 kilohertz. The sampled flame current signal establishes a time record of data for a given time portion of the flame current signal. Using a Fast Fourier Transform algorithm, the signal's time record is then transformed into a frequency spectrum that shows the frequency components of the input signal. This Fast Fourier Transform technique provides an advantage of speed in measuring the entire spectrum of frequency in a short time, as explained below.

If 1024 sampled data values are measured at 256 kilohertz, for example, it would take only 4 milliseconds to capture a spectrum from the highest to lowest frequency, where the highest frequency is determined by the period of two consecutive samples (128 kHz), and the lowest frequency is determined by the period of all samplings (¼ milliseconds=250 Hz). The output spectrum would represent frequencies from 250 Hertz to 128 kilohertz with frequency resolution points at every 250 Hertz. The magnitude of the spectrum and its frequencies is proportional to the square root of the Fast Fourier Transform.

The Fast Fourier Transform also enables the flame current signal data to be analyzed to identify variations in the flame that have hitherto been observed only by complex acoustic or optic techniques, which are generally referred to as thermo-acoustic spectrum. The controllers of the various embodiments are configured to analyze the flame current signal to identify variations within the flame current signal data that are comparable to thermo-acoustic spectra for identifying flame variations, as explained below.

In normal combustion conditions where air flow to the burner is in excess of that required for stoichiometry, the flame exhibits a generally flat thermo-acoustic spectrum. Similarly, during normal combustion conditions, the sampled flame current signal data that is measured and Fourier transformed provides a generally steady frequency spectrum. When combustion approaches a lean condition, it creates instabilities in the frequency spectrum, which may be visibly observed via a display output of a spectrum analyzer, for example. A spectrum analyzer is capable of displaying a spectrum over a given frequency range, where the spectrum displayed changes as properties of the signal change. One example of a spectrum analyzer is an SR760 Fast Fourier Transform spectrum analyzer. In a Fast Fourier Transform spectrum analyzer, the flame current input signal may be digitized at a high sampling rate for an interval in which the waveform is measured and Fourier transformed. The magnitude of the spectrum represents the total signal amplitude at each discrete frequency value/component, and allows for determining the amplitude of various frequency components within the frequency span of the spectrum.

Figure 2:
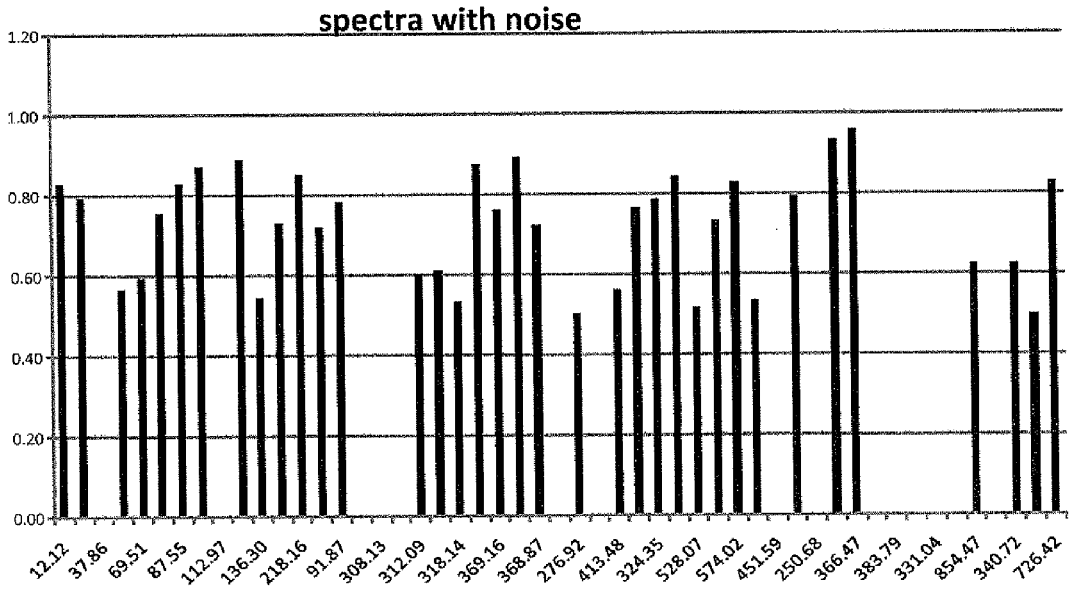
FIG. 2 shows a spectrum derived using Fourier transformed flame current data obtained from the flame current signal in FIG. 1, which indicates flame stability in accordance with the principles of the present disclosure.
Figure 3:
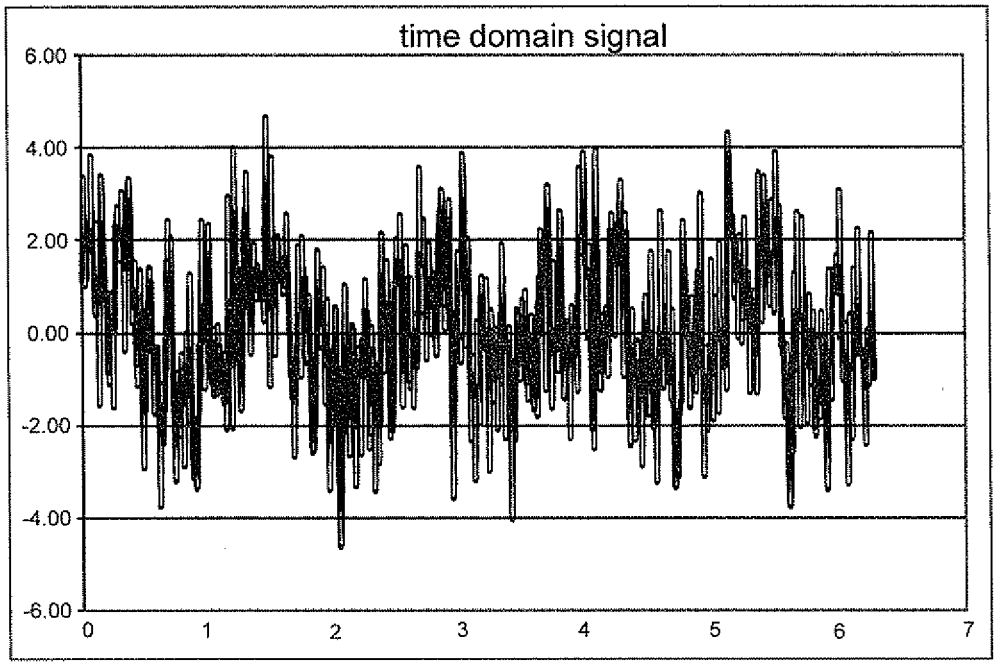
FIG. 3 shows a flame current signal that includes an occurrence of flame instability associated with abnormal combustion, in accordance with the principles of the present disclosure.
Figure 4:
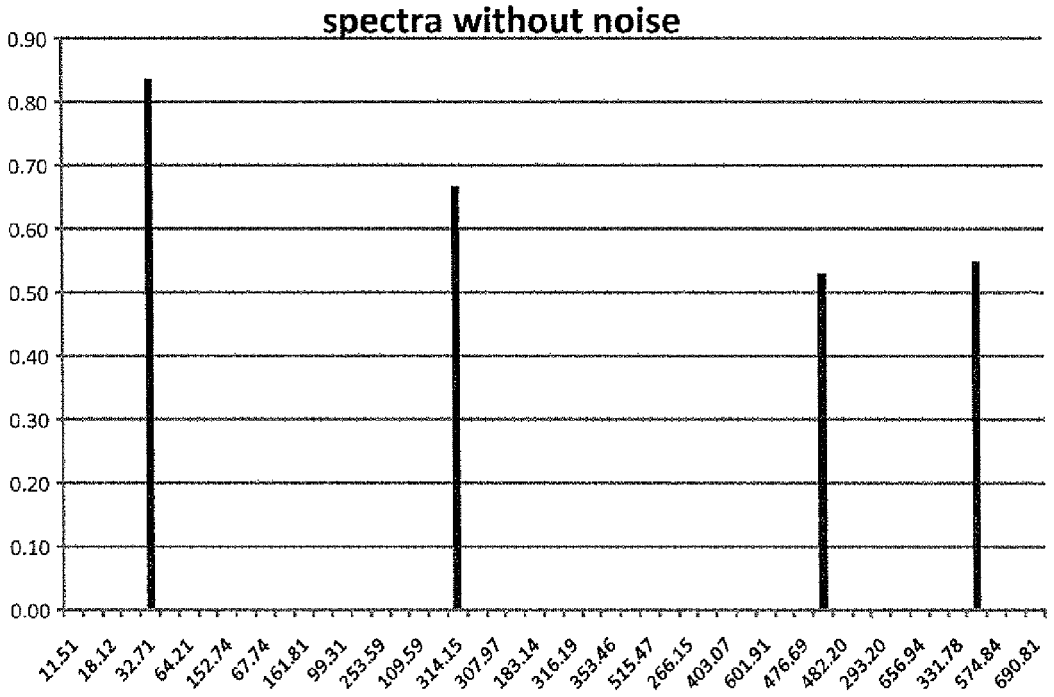
FIG. 4 shows a spectrum derived using Fourier transformed flame current data obtained from the flame current signal in FIG. 3, which indicates an instable flame in accordance with the principles of the present disclosure.

From the Fast Fourier Transform of flame current data, the controllers of the various embodiments can determine whether the amplitude of frequencies across the entire spectrum represents a generally flat 'thermo-acoustic' spectrum indicative of normal combustion, as in the example shown in FIG. 2. When an insufficient air to fuel flow ratio leads to less than desirable combustion, the flame current signal viewed on an oscilloscope would appear as shown in FIG. 3. From the waveform in FIG. 3, it is apparent that no characterization as to flame quality can be derived from the flame current signal due to its noise. However, using the flame current signal data that is measured and Fourier transformed, the controller 110 can determine whether a change in shape of the spectrum has occurred, such as where there are a number of spikes or component frequencies of higher amplitude in the spectrum that are representative of 'thermo-acoustic' and decreased combustion quality, as in the example shown in FIG. 4. Thus, as changes in the air-fuel ratio affect combustion and flame quality, the flame current signal data processed via a Fast Fourier Transform algorithm provides a means for detecting changes in the spectrum that indicate an occurrence of flame instability and compromised combustion quality. This approach overcomes the effects of aging or contamination of the flame sensor, which causes the magnitude of the flame current signal to decrease overtime. Since the present detection is based on a change in shape or signature of the frequency spectrum (and not flame current level), it is generally immune to sensor aging and contamination, as long as a sufficient signal magnitude is available to measure.

Figure 5:
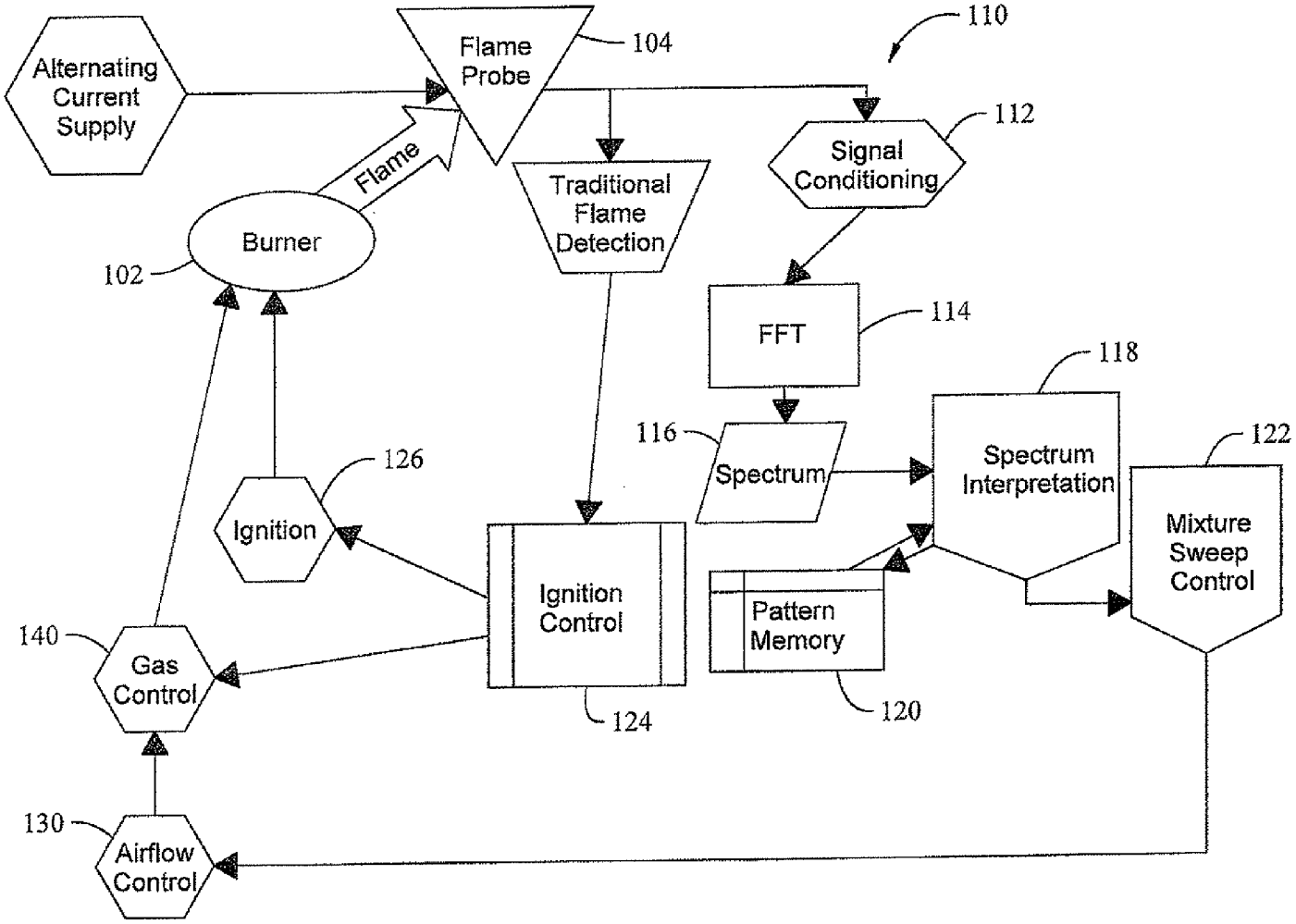
FIG. 5 shows a block diagram of one embodiment of a system and apparatus for burner control, in accordance with the principles of the present disclosure.

According to one aspect of the present disclosure, a system is provided for controlling a fuel-fired heating appliance. Referring to FIG. 5, a functional block diagram is shown of one embodiment of a system having a burner 102 and a fuel flow control 140 for controlling the rate of fuel flow to the burner 102. The system also includes a combustion air blower 130 having a motor for varying the flow rate of combustion air supplied to the burner 102, and a sensor 104 that senses a flame presence and outputs a flame current signal. The combustion air blower 130 and fuel flow control 140 are controlled by an apparatus that includes a controller 110 in communication with the combustion air blower 130, the fuel flow control 140, and the sensor 104, as described below.

The apparatus provides for detecting flame instability that may be caused by an inadequate air-to-fuel ratio, in controlling operation of a burner 102. The apparatus includes a probe sensor 104 that senses a flame at the burner 102 and provides an output of a flame current signal. The apparatus further includes a controller 110 in communication with the sensor 104. The controller 110 is preferably programmable, and encoded with an instruction operable to output a signal to reduce the speed of the combustion air blower 130 to reduce the flow rate of combustion air to the burner 102. The controller 110 is further configured to monitor the flame current signal to detect flame instability by measuring the sensed flame current signal waveform at a given data sampling rate and transforming the measured data into a spectrum of frequency components to identify a change from a generally steady spectrum indicative of flame stability to an instable spectrum indicative of flame instability. Such flame instability may be caused by an inadequate air flow relative to fuel flow to the burner 102, for example. In response to detecting a change of the measured spectrum to an instable spectrum indicative of flame instability, the controller 110 adjusts one of the speed of the combustion air blower 130 or the fuel flow control 140 to increase the air flow relative to the fuel flow until the controller 110 detects that the sensed flame current signal is indicative of flame stability associated with normal combustion.

In FIG. 5, the controller 110 is in communication with the combustion air blower 130 and upon detecting flame instability (from flame current signal data that is measured and Fourier transformed into a frequency spectrum that changes to an instable spectrum), the controller 110 responsively generates a signal to the combustion air blower. Specifically, the controller 110 responds to a flame instability condition by generating an output signal to a combustion air blower motor to increase the speed of the combustion air blower 130 that supplies air to the burner, to thereby increase the ratio of air-to-fuel to remedy the flame instability that is caused by an inadequate air-fuel ratio. The controller 110 may output one or more signals to incrementally increase the air flow to the burner 102 until the controller 110 detects a flame current signal representing a stable flame, as explained below.

As shown in FIG. 5, the controller 110 receives the flame current signal via a signal conditioning device 112, which may include an analog filter to attenuate frequencies above the range in which the signal is to be analyzed. The filtered flame current signal is measured at a given sampling rate, and the data input to a processor 114 (or other suitable circuitry) in which the signal data is measured and Fourier transformed to provide an output of a spectrum 116. The controller 110 may include a comparator 118 or other circuitry for analyzing the frequency spectrum. The controller 110 may further compare the measured spectrum to a predefined spectrum or frequency pattern associated with the particular type of burner that is stored in an electronic memory 120, to determine whether the flame current signal represents a generally steady spectrum indicative of flame stability and normal combustion. Similarly, the controller 110 is configured to determine whether spectrum for the flame current signal changes from a generally steady spectrum indicative of flame stability to an instable spectrum indicative of flame instability and less than desirable combustion. Such a condition may be caused by an inadequate air flow rate relative to the fuel flow rate. The controller 110 is configured to response to such a change by generating a signal via mixture control 122 to adjust the speed of the combustion air blower 130 to increase the air flow rate relative to the fuel flow rate until the flame current signal is indicative of normal combustion. Alternatively, the controller 110 may generate a signal to adjust the fuel flow control 140 for reducing the gas flow rate to the burner 102 to effectively increase the air flow rate relative to gas flow to the burner 102 until the flame current signal is indicative of normal combustion. Additionally, the controller 110 may adaptively identify an instable spectrum indicative of flame instability for a particular type of burner installed in the system.

Also shown in FIG. 5 is an ignition control 124 for controlling activation of fuel flow control 140 and an igniter 126 for establishing flame at the burner 102. Thereafter, the presence of flame may be detected either by the ignition control 124 or by the flame current monitoring circuitry of controller 110. The ignition control 124 and controller 110 may be combined in a signal integral control, or alternatively, the controller 110 may be separate from the ignition control 124.

Accordingly, FIG. 5 shows a system for controlling the operation of a burner, and also an exemplary embodiment of an apparatus for monitoring flame instability that has a sensor 104 for providing a flame current signal and a controller 110 in communication with the sensor 104. The controller 110 is configured to detect the occurrence of a flame instability condition from flame current signal data that is measured and Fourier transformed into a frequency spectrum that changes from a steady to instable spectrum when flame instability is caused by an inadequate air-to-fuel ratio, wherein the controller 110 is configured to respond to the detection of a flame instability condition by generating an output signal to increase the speed of a combustion air blower 130 that supplies air to the burner 102, to thereby increase the air flow rate relative to the fuel flow rate until the controller 110 detects that the flame current signal is indicative of normal combustion.

Figure 6:
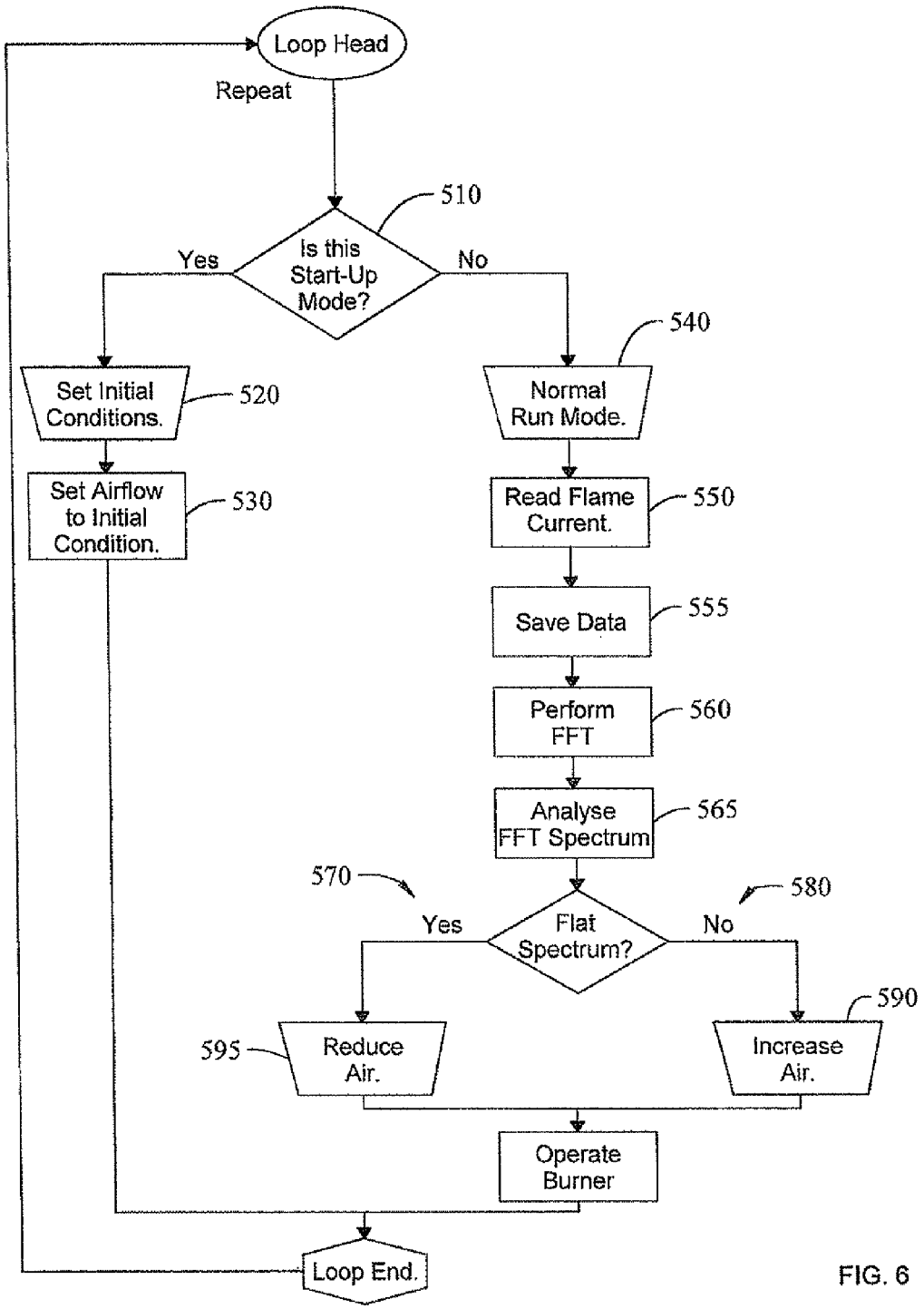
FIG. 6 shows a flow chart illustrating the control of burner operation by the embodiment shown in FIG. 5, in accordance with the principles of the present disclosure.

Referring to FIG. 6, a flow chart is shown illustrating the control method of the apparatus of the first embodiment. At step 510, the controller 110 of the apparatus determines whether the operation of the burner is in a normal run mode or a start-up mode. In start-up mode, the controller 110 sets the fuel flow control 140, igniter 126, and combustion air blower 130 to initial conditions for establishing operation of the burner 102 at steps 520, 530. In normal run mode 540, the controller 110 proceeds at step 550 to read or measure the flame current signal at a given data sampling rate, and then save the data at step 555. The flame current signal data is then transformed using a Fast Fourier Transform algorithm at step 560, into a frequency spectrum that shows the frequency components of the flame current signal. At step 565, the Fourier transformed data or frequency spectrum is analyzed, to determine whether the flame current signal represents a generally steady spectrum indicative of flame stability and normal combustion at 570, or whether the spectrum has changed from a generally steady spectrum to an instable spectrum 580 that is indicative of flame instability and less than desirable combustion. The controller 110 is configured to respond to spectrum indicating flame instability by generating an output signal to increase the speed of the combustion air blower 130 and combustion air flow to the burner 102 at step 590. The loop in FIG. 5 may be repeated and the speed of the blower increased again at step 590 until the controller 110 detects Fourier transformed flame current data with a spectrum that is indicative of normal combustion (570). The method also provides for generating an output signal to reduce the speed of the blower's variable speed motor, to reduce the flow rate of combustion air to the burner until the occurrence of flame instability is detected at step 595.

Accordingly, one embodiment of a method for controlling operation of a burner in a fuel-fired heating appliance is provided. The method comprises sensing a flame current at a burner and providing an output of a flame current signal, and monitoring the flame current signal to detect flame instability. The method may detect flame instability by measuring the sensed flame current signal waveform at a given data sampling rate, and transforming the measured data into a spectrum of frequency components of varying amplitude, to detect a change from a generally steady spectrum indicative of flame stability to an instable spectrum indicative of flame instability. The method further includes reducing the speed of a combustion air blower to reduce the flow rate of combustion air to the burner until the occurrence of flame instability is detected, and incrementally increasing the speed of a combustion air blower until the sensed flame current signal and associated spectrum is indicative of normal combustion.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for controlling operation of a fuel-fired heating appliance having a burner, a fuel flow control for controlling a fuel flow to the burner, and an combustion air blower for supplying combustion air to the burner, the method comprising:

sensing a flame at the burner and outputting a time-varying flame current signal including an ionization signal from the flame;

sampling the flame current signal to obtain a time record of the flame current signal;

using a Fourier transformation, transforming the time record into a frequency spectrum of frequency components including frequency components of the ionization signal, the frequency spectrum having a spectrum shape defined by various frequency components of the flame current signal;

comparing frequency spectrum shapes to determine whether the flame current signal changes from presenting a frequency spectrum shape indicative of flame stability and normal combustion to presenting a frequency spectrum shape indicative of flame instability and less than desirable combustion caused by an inadequate air flow rate relative to the fuel flow rate;

and if a flame instability condition is detected, generating a signal for adjusting a speed of the combustion air blower to adjust air flow relative to fuel flow rate or for adjusting the fuel flow control to adjust fuel flow rate to the burner monitoring the flame current signal to detect flame instability by measuring the flame current signal waveform at a given data sampling rate; transforming the time record, using a Fast Fourier Transform algorithm, into the frequency spectrum; and analyzing the frequency spectrum to determine whether the spectrum exhibits ionization signal frequency components indicative of flame stability and normal combustion, or whether the frequency spectrum exhibits frequency spikes indicative of flame instability; generating a signal for reducing speed of the combustion air blower to reduce air flow rate of combustion air to the burner; reducing the speed of the combustion air blower until a frequency spectrum indicative of flame instability is detected; generating a signal for incrementally increasing the speed of the combustion air blower; and incrementally increasing the speed of the combustion air blower until a frequency spectrum indicative of normal combustion is detected.

* * * * *